US010182599B2

(12) United States Patent
Zhu

(10) Patent No.: US 10,182,599 B2
(45) Date of Patent: Jan. 22, 2019

(54) ADJUSTABLE VOLUME E-LIQUID STORAGE TANK AND ELECTRONIC CIGARETTES HAVING THE SAME

(71) Applicant: SHENZHEN KANGER TECHNOLOGY CO., LTD., Shenzhen (CN)

(72) Inventor: Xiaochun Zhu, Shenzhen (CN)

(73) Assignee: SHENZHEN KANGER TECHNOLOGY CO., LTD., Shenzhen, Guangdong (CN)

( * ) Notice: Subject to any disclaimer, the term of this patent is extended or adjusted under 35 U.S.C. 154(b) by 36 days.

(21) Appl. No.: 15/603,698

(22) Filed: May 24, 2017

(65) Prior Publication Data

US 2018/0338528 A1 Nov. 29, 2018

(30) Foreign Application Priority Data

May 23, 2017 (CN) ..... 2017 1 0369238

(51) Int. Cl.

| | |
|---|---|
| ***A24F 13/00*** | (2006.01) |
| ***A24F 47/00*** | (2006.01) |
| ***H05B 1/02*** | (2006.01) |
| ***B65D 21/08*** | (2006.01) |
| ***B65D 25/54*** | (2006.01) |

(52) U.S. Cl.

CPC ..... *A24F 47/008* (2013.01); *B65D 21/08* (2013.01); *B65D 25/54* (2013.01); *H05B 1/02* (2013.01)

(58) Field of Classification Search

CPC ..... A24F 47/008; A24F 47/00
USPC ..... 131/328–329
See application file for complete search history.

(56) References Cited

U.S. PATENT DOCUMENTS

2016/0007654 A1* 1/2016 Zhu ..... A24F 47/008 131/328

* cited by examiner

*Primary Examiner* — Phuong K Dinh
(74) *Attorney, Agent, or Firm* — Ming Jiang; MM IP Services LLC

(57) ABSTRACT

Present disclosure relates to a volume adjustable E-liquid storage tank, electronic cigarettes having the volume adjustable E-liquid storage tank, and methods of using the electronic cigarettes having the volume adjustable E-liquid storage tank. In certain embodiments, the E-liquid storage tank includes: an E-liquid refill base, an E-liquid storage tank internal wall, an E-liquid storage tank external wall, a vaporizer assembly mounting base, and a volume adjustment ring. The E-liquid storage tank is sealed by a first mouthpiece sealing ring on the top, and a vaporizer sealing ring at the bottom. The volume adjustment ring is installed inside the E-liquid storage tank between the E-liquid storage tank internal wall and the E-liquid storage tank external wall to reduce the amount of E-liquid filled in the E-liquid storage tank. The thickness and the height of the volume adjustment ring may vary to adjust the amount of E-liquid in the E-liquid storage tank.

20 Claims, 9 Drawing Sheets

ADJUSTABLE VOLUME E-LIQUID STORAGE TANK AND ELECTRONIC CIGARETTES HAVING THE SAME

FIELD

The present disclosure generally relates to the field of electronic cigarettes, and more particularly to an adjustable E-liquid storage tank, electronic cigarettes having the adjustable E-liquid storage tank, and methods of using the electronic cigarettes having the adjustable E-liquid storage tank.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

It is well known that smoking cigarette is harmful to smoker's health. The active ingredient in a cigarette is mainly nicotine. During smoking, nicotine, along with tar aerosol droplets produced in the cigarette burning, are breathed into the alveolus and absorbed quickly by the smoker. Once nicotine is absorbed into the blood of the smoker, nicotine then produces its effect on the receptors of the smoker's central nervous system, causing the smoker relax and enjoy an inebriety similar to that produced by an exhilarant.

The electronic cigarette is sometimes referred as electronic vaporing device, personal vaporizer (PV), or electronic nicotine delivery system (ENDS). It is a battery-powered device which simulates tobacco smoking. It generally uses a heating element that vaporizes a liquid solution (e-liquid). Some solutions contain a mixture of nicotine and a variety of flavorings, while others release a flavored vapor without nicotine. Many are designed to simulate smoking experience, such as cigarette smoking or cigar smoking. Some of them are made with similar appearance, while others are made considerably different in appearance.

Conventional electronic cigarettes have one E-liquid storage tank, and the size and volume are limited to the original design, therefore the volume of E-liquid stored in the E-liquid storage tank is fixed. For certain electronic cigarette smoker, it is desirable that the electronic cigarette has an ability to store various amount of E-liquid in the E-liquid storage tank so that a user can control the actual volume of the E-liquid for refilling.

Therefore, an unaddressed need exists in the art to address the aforementioned deficiencies and inadequacies.

SUMMARY

In one aspect, the present disclosure relates to an E-liquid storage tank for an electronic cigarette. In certain embodiments, the E-liquid storage tank includes: an E-liquid refill base, an E-liquid storage tank internal wall, an E-liquid storage tank external wall, a vaporizer assembly mounting base, and a volume adjustment ring. The volume adjustment ring is installed inside the E-liquid storage tank between the E-liquid storage tank internal wall and the E-liquid storage tank external wall to reduce the amount of E-liquid filled in the E-liquid storage tank. The E-liquid storage tank is sealed by a first mouthpiece sealing ring on the top, and a vaporizer sealing ring at the bottom.

In certain embodiments, the E-liquid storage tank external wall is made of transparent materials such that remaining E-liquid level may be shown to a user. The transparent materials include: plastics, acrylics, and glass. In certain embodiments, the thickness and the height of the volume adjustment ring may vary to adjust the amount of E-liquid to be filled in the E-liquid storage tank. In one embodiment, the volume adjustment ring may be removed to achieve maximum E-liquid storage tank volume. In certain embodiments, the volume adjustment ring may be made of silicone gel, plastics, acrylic, glass, and metals.

In another aspect, the present disclosure relates to an electronic cigarette. In certain embodiments, the electronic cigarette includes an E-liquid storage tank, and a vaporizer assembly. The volume of the E-liquid storage tank is adjustable. The vaporizer assembly includes a heating element assembly.

In certain embodiments, the E-liquid storage tank includes: an E-liquid refill base, an E-liquid storage tank internal wall, an E-liquid storage tank external wall, a vaporizer assembly mounting base, and a volume adjustment ring. The volume adjustment ring is installed inside the E-liquid storage tank between the E-liquid storage tank internal wall and the E-liquid storage tank external wall to reduce the amount of E-liquid filled in the E-liquid storage tank. The E-liquid storage tank is sealed by a first mouthpiece sealing ring on the top, and a vaporizer sealing ring at the bottom.

In certain embodiments, the electronic cigarette also includes an electronic cigarette base assembly. The electronic cigarette base assembly has: a switch mounting ring, an air chamber body, and an air intake adjustment ring. The switch mounting ring is mounted at a bottom end of the vaporizer assembly mounting base. Each of the push button switches is installed on the switch mounting ring along its perimeter. The air chamber body defines a first air chamber opening, and a second air chamber opening. The air chamber body is positioned between the vaporizer assembly mounting base and the switch mounting ring to form an air chamber. The air intake adjustment ring defines a first air intake opening and a second air intake opening for the user to adjust air intake by rotating the air intake adjustment ring to coincide the first air chamber opening and the second air chamber opening, respectively. Each of the switch mounting ring, the vaporizer assembly mounting base, the air chamber body, and the air intake adjustment ring is in a ring shape to form the air chamber inside the air chamber body.

In yet another aspect, the present disclosure relates to a method of using an electronic cigarette having an adjustable volume E-liquid storage tank. In certain embodiments, the method includes: adjusting, by a user, the volume of the E-liquid storage tank by installing a volume adjustment ring into an E-liquid storage tank, and filling, by the user, E-liquid into the E-liquid storage tank. The method also includes: pressing, by the user, one or more push button switches to turn on an electrical power supply to one or more heating elements according to the desired amount E-liquid vapor the user wishes to have, and sucking, by the user, E-liquid vapor from the vaporizer assembly through a mouthpiece. Air outside of the electronic cigarette enters the vaporizer assembly through a first air intake opening and a second air intake opening defined on an air intake adjustment ring that coincide a first air chamber opening and a second air chamber opening defined on an air chamber body, respectively. The E-liquid vapor formed by the vaporizer assembly exits through the mouthpiece.

In certain embodiments, the method may also include: removing, by the user, the volume adjustment ring from the E-liquid storage tank to obtain maximum E-liquid capacity of the E-liquid storage tank, and removing, by the user, the electrical power supply from the electronic cigarette for replacement or recharging. The method may also include: connecting, by the user, the electrical power supply to a positive terminal and a negative terminal of the electronic cigarette. The electrical power supply includes a battery, or a rechargeable battery. The electrical power supply is connected to the positive terminal and the negative terminal of the electronic cigarette through one of: a T-shaped groove connector, a dovetail shaped slot connector, a magnetic attachment connector, a threaded connector, and a multi-threaded connector.

These and other aspects of the present disclosure will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and, together with the written description, serve to explain the principles of the disclosure. Wherever possible, the same reference numbers are used throughout the drawings to refer to the same or like elements of an embodiment. The drawings do not limit the present disclosure to the specific embodiments disclosed and described herein. The drawings are not necessarily to scale, emphasis instead being placed upon clearly illustrating the principles of the disclosure, and wherein.

DETAILED DESCRIPTION

Figure 1:
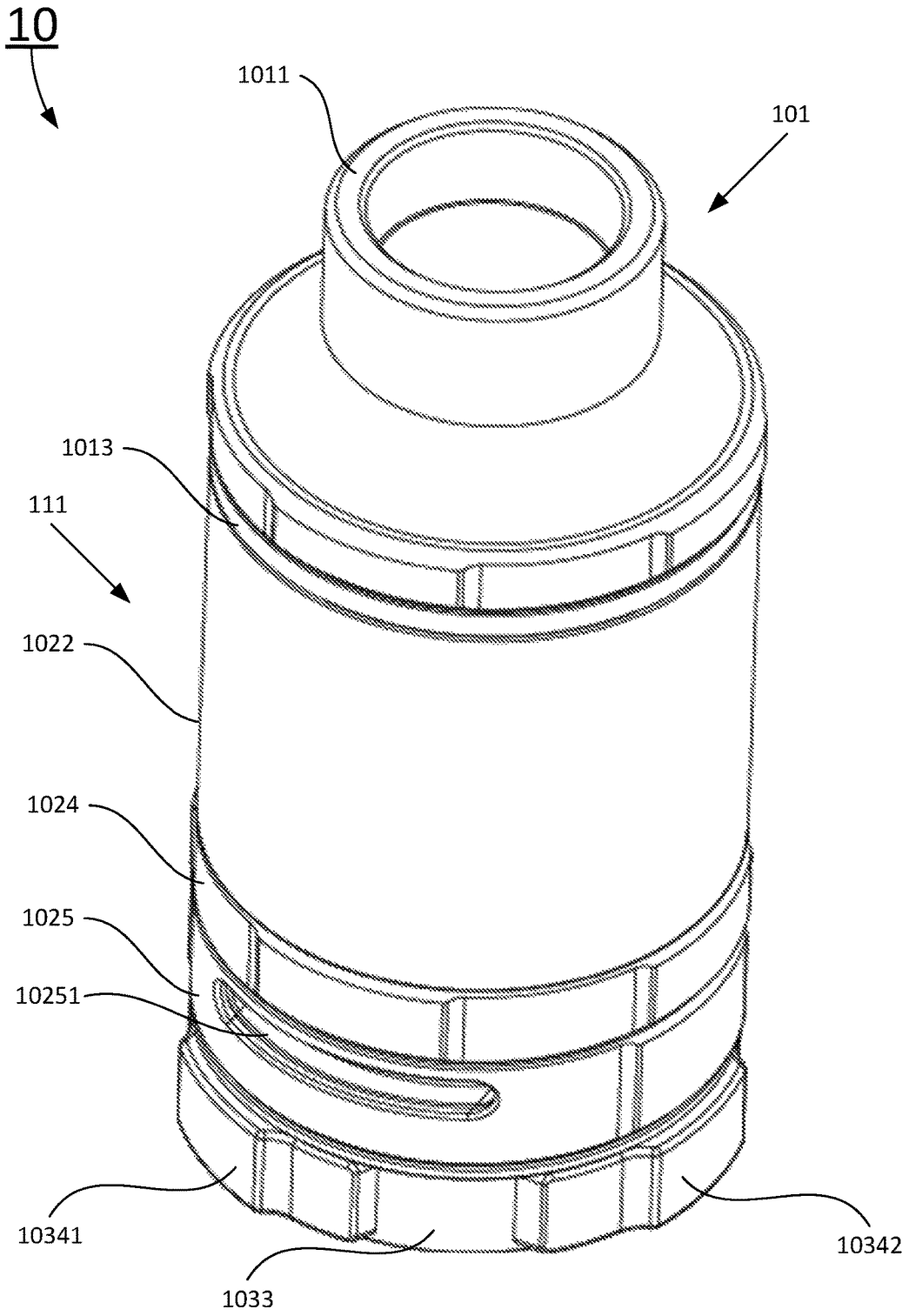
FIG. 1 is a perspective external view of an exemplary electronic cigarette having adjustable E-liquid storage tank according to certain embodiments of the present disclosure.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present disclosure be fully understood, but the present disclosure may also be implemented by using other manners different from those described herein, so that the present disclosure is not limited by the specific embodiments disclosed in the following.

The description will be made as to the embodiments of the present disclosure in conjunction with the accompanying drawings FIGS. 1 through 9.

Referring now to FIGS. 4-7, in one aspect, the present disclosure relates to an E-liquid storage tank 111 for an electronic cigarette 10. In certain embodiments, the E-liquid storage tank 111 includes: an E-liquid refill base 1013, an E-liquid storage tank internal wall 1041, an E-liquid storage tank external wall 1022, a vaporizer assembly mounting base 1024, and a volume adjustment ring 1044. The volume adjustment ring 1044 is installed inside the E-liquid storage tank 111 between the E-liquid storage tank internal wall 1041 and the E-liquid storage tank external wall 1022 to reduce the amount of E-liquid filled in the E-liquid storage tank 111. The E-liquid storage tank is sealed by a first mouthpiece sealing ring 1014 on the top, and a vaporizer sealing ring 1028 at the bottom.

In certain embodiments, the E-liquid storage tank external wall 1022 is made of transparent materials such that remaining E-liquid level may be shown to a user. The transparent materials include: plastics, acrylics, and glass. In certain embodiments, the volume adjustment ring 1044 may be made of silicone gel, plastics, acrylic, glass, and metals.

In certain embodiments, the thickness and the height of the volume adjustment ring 1044 may vary to adjust the amount of E-liquid to be filled in the E-liquid storage tank 111. In one embodiment, the volume adjustment ring 1044 having full height as the E-liquid storage tank internal wall 1041 and the E-liquid storage tank external wall 1022 is installed inside the E-liquid storage tank 111 between the E-liquid storage tank internal wall 1041 and the E-liquid storage tank external wall 1022 while the E-liquid refill base 1013 and the vaporizer assembly mounting base 1024 hold the volume adjustment ring 1044 in place. In another embodiment, the volume adjustment ring 1044 not having full height as the E-liquid storage tank internal wall 1041 and the E-liquid storage tank external wall 1022 may be sized to fit inside the E-liquid storage tank external wall 1022 and attach the E-liquid storage tank external wall 1022. In this embodiment, in order to show the remaining E-liquid level in the E-liquid storage tank 111, the volume adjustment ring 1044 may be made of transparent materials such as plastics, acrylics, and glass as the E-liquid storage tank external wall 1022. In yet another embodiment, the E-liquid storage tank external wall 1022 may be made thicker to take more space of the E-liquid storage tank 111 and reduce the volume of the E-liquid storage tank 111.

In certain embodiments, the volume adjustment ring 1044 may be removed to achieve maximum E-liquid storage tank volume.

Referring now to FIGS. 1-8, in another aspect, the present disclosure relates to an electronic cigarette 10. In certain embodiments, the electronic cigarette 10 has a mouthpiece assembly 101, an E-liquid storage tank 111, a volume adjustment ring 1044, a vaporizer assembly 102, a heating element assembly 104 inside the vaporizer assembly 102, and an electronic cigarette base assembly 103.

In certain embodiments, as shown in FIGS. 1-5, the mouthpiece assembly 101 has: a mouthpiece 1011 for user to enjoy vaporized E-liquid, a mouthpiece fastener 1012 positioned coaxially inside the mouthpiece 1011 to form an internal vapor pathway, and a threaded mouthpiece mounting ring 1016 having external threads to mount the mouthpiece assembly 101 on the vaporizer assembly 102 through an internal mouthpiece mounting threads 1021 of the vaporizer assembly 102. A top end of the E-liquid storage tank 111 is sealed by a first mouthpiece sealing ring 1015. A second mouthpiece sealing ring 1018 blocks E-liquid vapor passage between the mouthpiece 1011 and the threaded mouthpiece mounting ring 1016.

Figure 4:
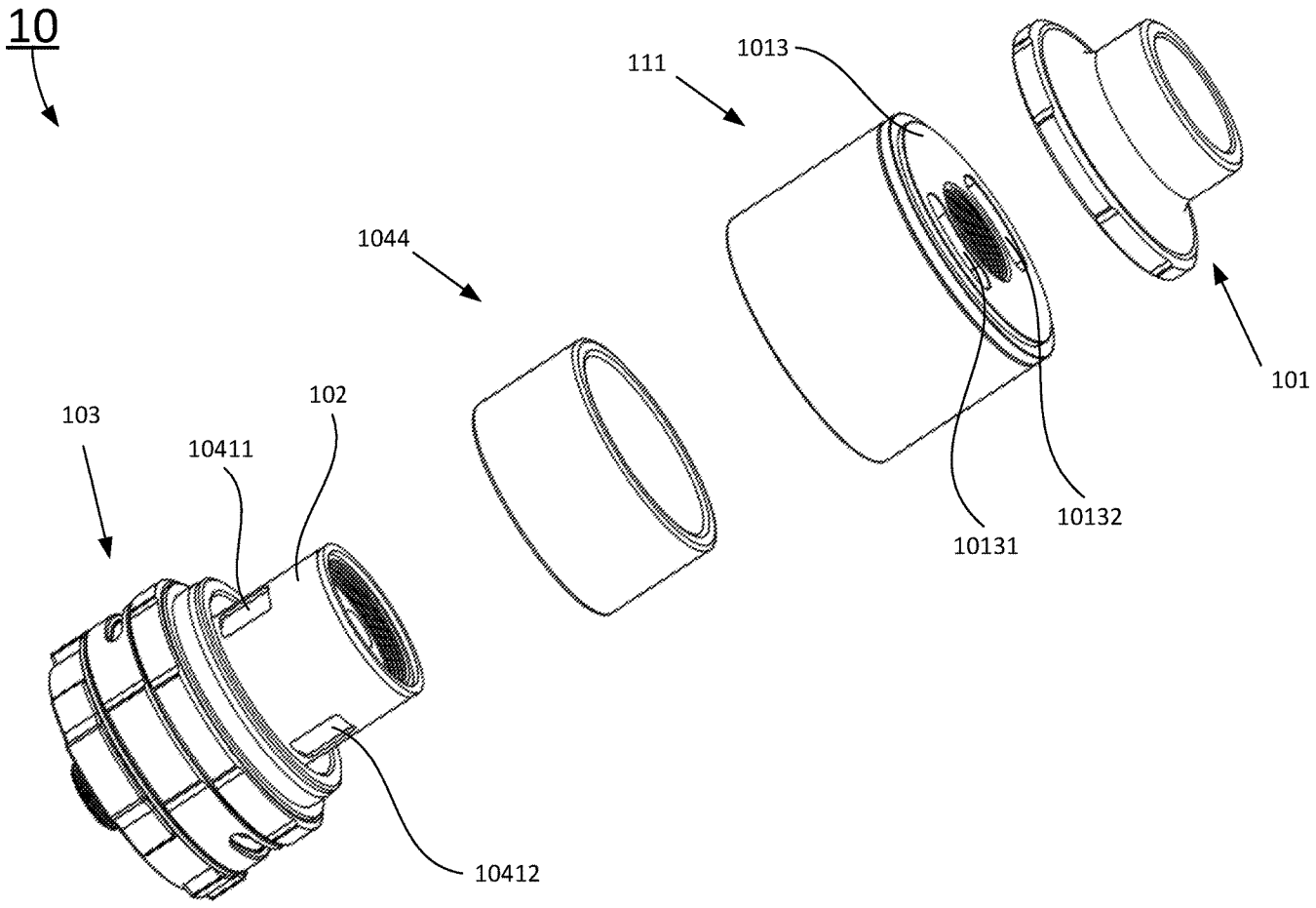
FIG. 4 is an exploded perspective view of the exemplary electronic cigarette showing major components according to certain embodiments of the present disclosure.
Figure 5:
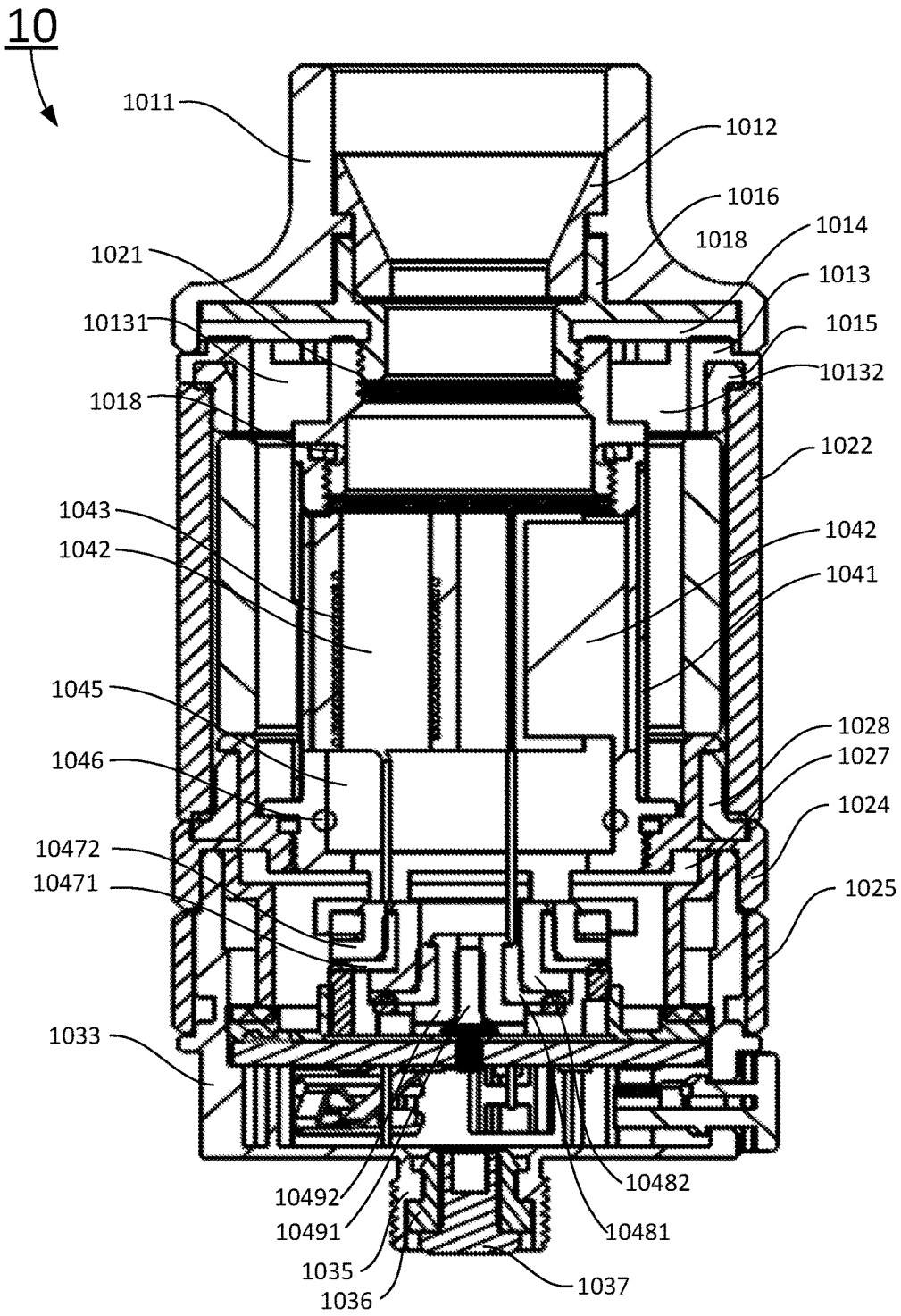
FIG. 5 is a sectional view of the exemplary electronic cigarette having adjustable E-liquid storage tank according to certain embodiments of the present disclosure.
Figure 6:
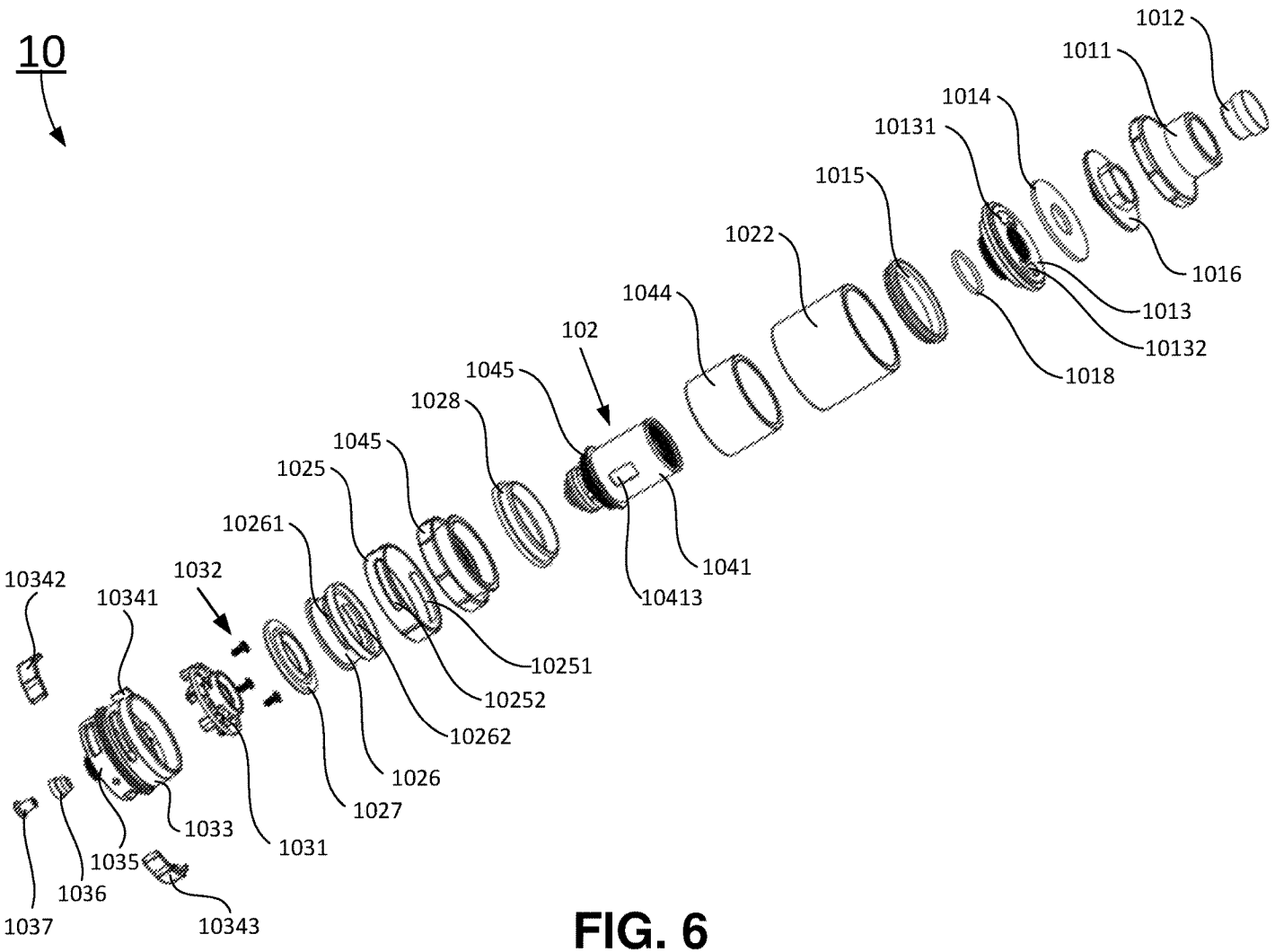
FIG. 6 is an exploded perspective view of the exemplary electronic cigarette having adjustable E-liquid storage tank according to certain embodiments of the present disclosure.

In certain embodiments, the E-liquid storage tank 111 includes: an E-liquid refill base 1013, an E-liquid storage tank internal wall 1041, an E-liquid storage tank external wall 1022, a vaporizer assembly mounting base 1024, and a volume adjustment ring 1044. The volume adjustment ring 1044 is installed inside the E-liquid storage tank 111 between the E-liquid storage tank internal wall 1041 and the E-liquid storage tank external wall 1022 to reduce the amount of E-liquid filled in the E-liquid storage tank 111. The E-liquid storage tank is sealed by a first mouthpiece sealing ring 1014 on the top, and a vaporizer sealing ring 1028 at the bottom. As shown in FIGS. 4-6, the E-liquid refill base 1013 defines a first refill opening 10131, and a second refill opening 10132 for refilling the E-liquid storage tank 111. When the E-liquid storage tank 111 needs to be refilled, a user may remove the mouthpiece assembly 101 from the top and fill the E-liquid into the E-liquid storage tank 111 through the first refill opening 10131 and second refill opening 10132.

In certain embodiments, the E-liquid storage tank external wall 1022 is made of transparent materials such that remaining E-liquid level may be shown to a user. The transparent materials include: plastics, acrylics, and glass. In certain embodiments, the volume adjustment ring 1044 may be made of silicone gel, plastics, acrylic, glass, and metals.

In certain embodiments, the thickness and the height of the volume adjustment ring 1044 may vary to adjust the amount of E-liquid to be filled in the E-liquid storage tank 111. In one embodiment, the volume adjustment ring 1044 having full height as the E-liquid storage tank internal wall 1041 and the E-liquid storage tank external wall 1022 is installed inside the E-liquid storage tank 111 between the E-liquid storage tank internal wall 1041 and the E-liquid storage tank external wall 1022 while the E-liquid refill base 1013 and the vaporizer assembly mounting base 1024 hold the volume adjustment ring 1044 in place. In another embodiment, the volume adjustment ring 1044 not having full height as the E-liquid storage tank internal wall 1041 and the E-liquid storage tank external wall 1022 may be sized to fit inside the E-liquid storage tank external wall 1022 and attach the E-liquid storage tank external wall 1022. In this embodiment, in order to show the remaining E-liquid level in the E-liquid storage tank 111, the volume adjustment ring 1044 may be made of transparent materials such as plastics, acrylics, and glass as the E-liquid storage tank external wall 1022. In yet another embodiment, the E-liquid storage tank external wall 1022 may be made thicker to take more space of the E-liquid storage tank 111 and reduce the volume of the E-liquid storage tank 111.

In certain embodiments, the volume adjustment ring 1044 may be removed to achieve maximum E-liquid storage tank volume.

In certain embodiments, as shown in FIGS. 4-8, the vaporizer assembly 102 is positioned inside the E-liquid storage tank internal wall 1041 and attached to the vaporizer assembly mounting base 1024. The vaporizer assembly 102 includes a heating element assembly 104 inside the vaporizer assembly 102.

Figure 7:
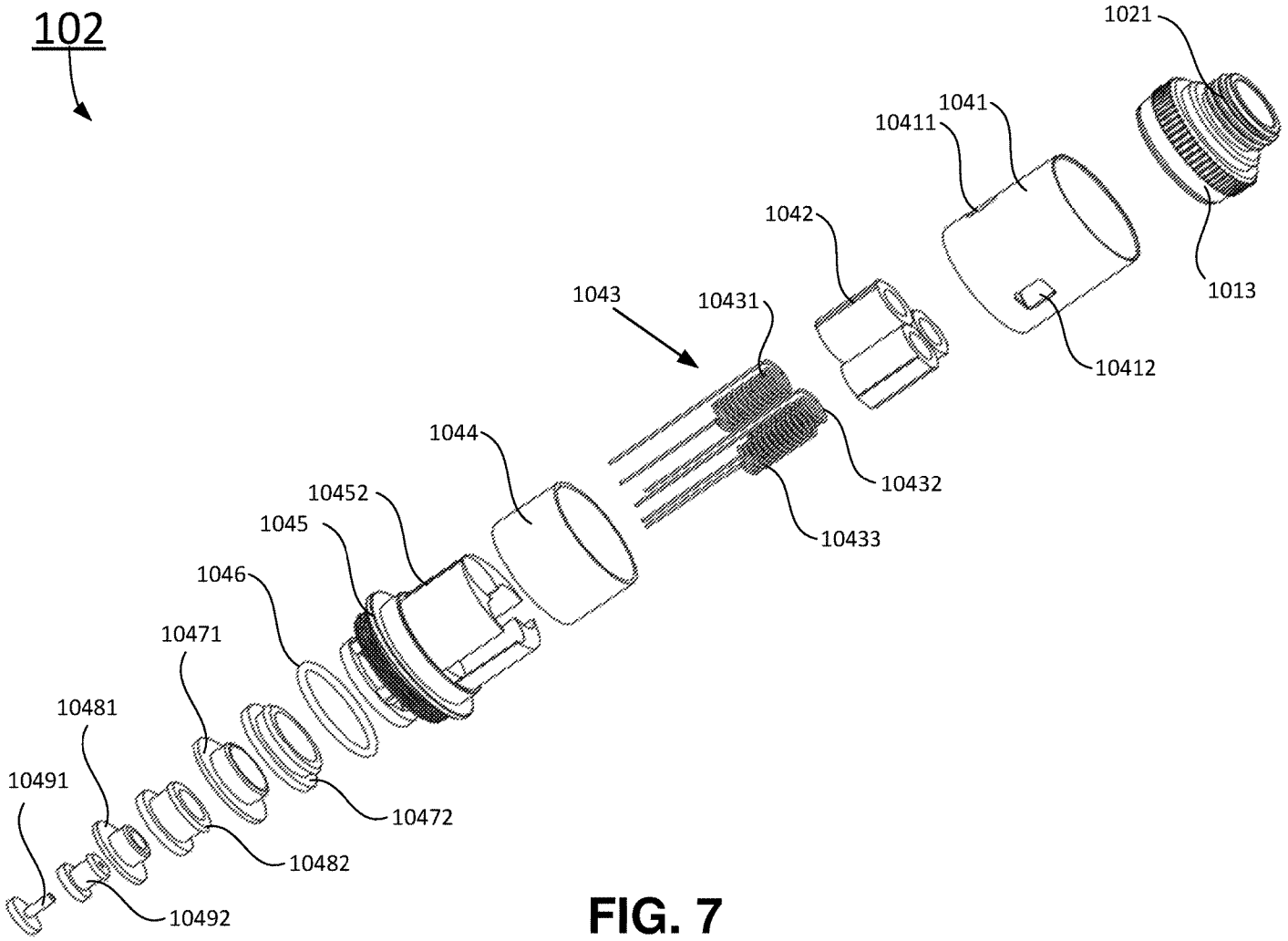
FIG. 7 is an exploded perspective view of a vaporizer assembly according to certain embodiments of the present disclosure.

In certain embodiments, the heating element assembly 104 is installed on a heating element base 1045. The heating element assembly 104 includes an E-liquid storage tank internal wall 1041 defining multiple E-liquid openings. In an exemplary embodiment as shown in FIG. 7, the vaporizer assembly 102 includes multiple heating elements 1043. In the exemplary embodiment shown in FIG. 7, the heating elements 1043 include a first heating element 10431, a second heating element 10432, and a third heating element 10433. The E-liquid storage tank internal wall 1041 defines a first E-liquid opening 10411, a second E-liquid opening 10412, and a third E-liquid opening 10413 (not shown in FIG. 7). These E-liquid openings allow an external E-liquid storage medium 10452 positioned inside of the E-liquid storage tank internal wall 1041, and an internal E-liquid storage medium 1042 positioned inside of the external E-liquid storage medium 10452 to receive E-liquid from the E-liquid storage tank 111. These heating elements 1043 are in direct contact with surface of the internal E-liquid storage medium 1042 to heat the E-liquid received from the E-liquid storage tank 111. Each of the first heating element 10431, the second heating element 10432, and the third heating element 10433 can be turned on by a user of the electronic cigarette 10 individually. The user may switch on one or more of the heating elements 1043 to adjust the vaporization of the E-liquid by the vaporizer assembly 102.

In certain embodiments, these heating elements 1043 may be made with one or more of: aluminum (Al), Chromium (Cr), Manganese (Mn), Iron (Fe), Cobalt (Co), Nickel (Ni), Copper (Cu), Zirconium (Zr), Niobium (Nb), Molybdenur (Mo), Rhenium (Re), Silver (Ag), Cadmium (Cd), Tantalum (Ta), Tungsten (W), Iridium (Ir), Platinum (Pt), Gold (Au), and alloys of these materials.

In certain embodiments, each of the heating elements 1043 may include: a grid shaped heating element, a mesh shaped heating element, a net shaped heating element, a spiral heating element, and any combination of these shapes. The internal E-liquid storage medium 1042 are made to accommodate the specific shapes of the heating elements 1043. Each of the first heating element 10431, the second heating element 10432, and the third heating element 10433 is in a cylindrical shape. The internal E-liquid storage medium 1042 includes three cylindrical shaped E-liquid storage media to match the shapes of the heating elements. The heating element base 1045 are also made to accommodate the specific shapes of the internal E-liquid storage medium 1042. Each of the external E-liquid storage medium 10452 and the internal E-liquid storage medium 1042 includes: cotton fibers, polypropylene fibers, terylene fibers, nylon fibers, and porous ceramic materials.

In certain embodiments, each of the heating elements 1043 includes a positive terminal and a negative terminal. Each of the positive terminal of the heating elements 1043 is electrically coupled to a positive terminal 1037 of an electrical power supply through a push button switch in serial, and each of the negative terminal of the heating elements 1043 is electrically coupled to a negative terminal 1035 of the electrical power supply. The positive terminal 1037 and the negative terminal 1035 are isolated by a positive terminal isolation ring 1036.

Figure 8:
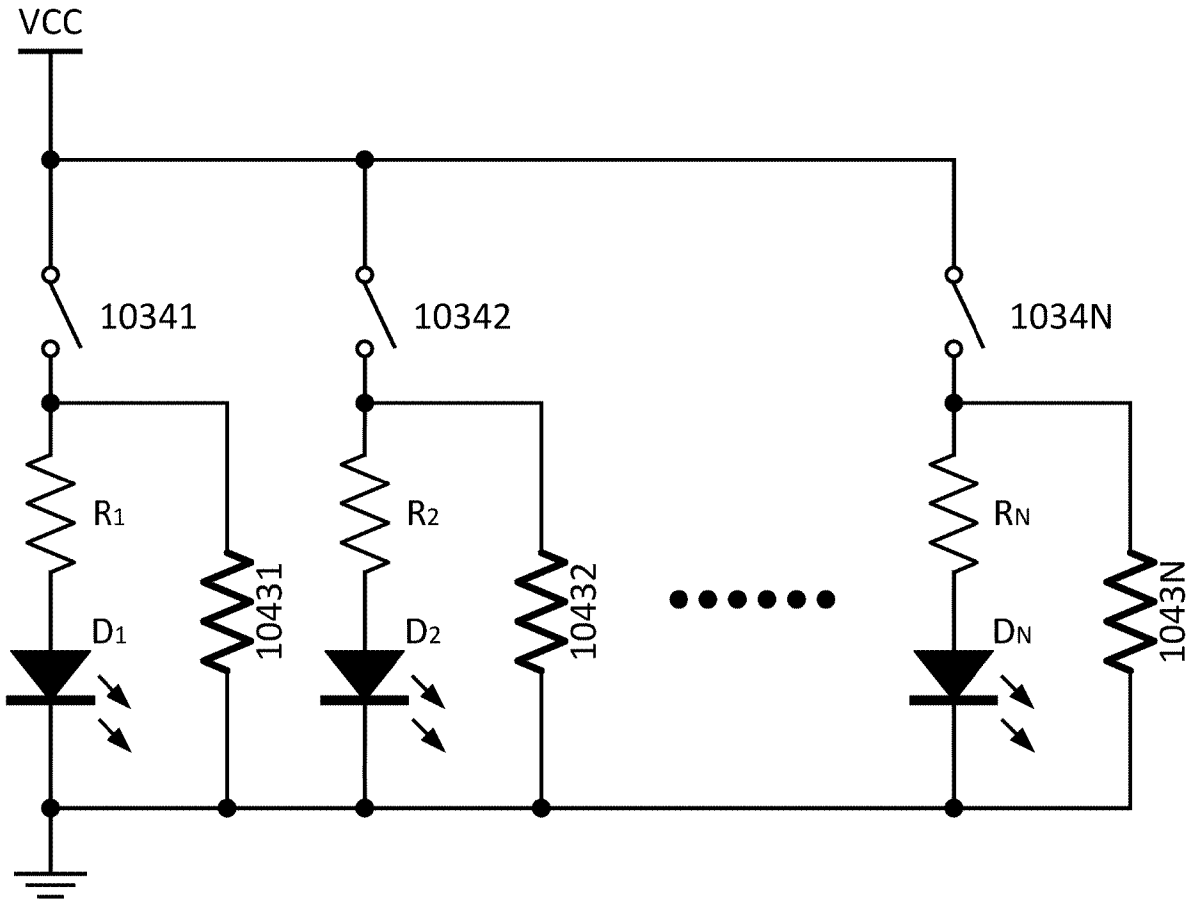
FIG. 8 is a circuit diagram of the exemplary electronic cigarette according to certain embodiments of the present disclosure and FIG. 9 is a flow chart of an exemplary method of using the electronic cigarette having adjustable E-liquid storage tank according to certain embodiments of the present disclosure.

In certain embodiments, the electronic cigarette 10 also includes a printed circuit board 1031 as shown in FIG. 6. The printed circuit board 1031 is in a circular shape to allow air to flow through the center. The printed circuit board 1031 forms an electronic circuit for the electronic cigarette 10 as shown in FIG. 8. The electronic circuit shown in FIG. 8 includes N heating elements 10431, 10432, . . . , and 1043N, N push button switches 10341, 10342, . . . , and 1034N, and N display circuits. Here, N is a positive integer, and the electronic circuit includes one push button switch, one switching terminal, and one output terminal for each of the heating elements 1043.

The printed circuit board 1031 includes: a positive terminal VCC, a negative terminal or ground of the electrical power supply as shown in FIG. 8, N switching terminals connecting to the positive terminal VCC to each of N push button switches, and N output terminal connecting each of N push button switches to each of the heating elements 10431, 10432, . . . , and 1043N, respectively. The number of switching terminals, and the number of output terminals are the same as the predetermined number of heating elements 1043.

The positive terminal of the printed circuit board 1031 is electrically coupled to a positive terminal 1037 of the electrical power supply. Each of push button switches is used to provide electrical power control to a corresponding heating element. The negative terminal of the printed circuit board 1031 is electrically coupled to a negative terminal 1035 of the electrical power supply. The positive terminal 1037 and the negative terminal 1035 are isolated by the positive terminal isolation ring 1036. As shown in FIG. 6, the printed circuit board 1031 is installed on a switch mounting ring 1033 with several PCB fasteners 1032. A silicone gel cover 1027 is installed on the top of the printed circuit board 1031 to prevent any liquid or E-liquid to contact the printed circuit board 1031.

In certain embodiments, each push button switch has a first terminal electrically coupled to a corresponding switching terminal, and a second terminal electrically coupled to a corresponding output terminal and the positive terminal of a corresponding heating element. The negative terminal of the corresponding heating element is electrically coupled to the negative terminal of the printed circuit board 1031 and the negative terminal 1035 of the electrical power supply. In certain embodiments, each of the heating elements 1043 is parallelly coupled to a display circuit having a resistor and a light emitting diode connected in serial to indicate whether the heating element is powered up and in use.

In certain embodiments, each of the heating elements 1043 has a positive terminal and a negative terminal. The positive terminal of the heating element is electrically coupled to a positive terminal 1037 of an electrical power supply through a push button switch in serial, and the negative terminal of the heating element is electrically coupled to the negative terminal 1035. As shown in FIG. 4, the vaporizer assembly 102 includes three heating elements: a first heating element 10431, a second heating element 10432, and a third heating element 10433. The first heating element 10431 is connected to the positive terminal 1037 through a first positive terminal 10471. The second heating element 10432 is connected to the positive terminal 1037 through a second positive terminal 10481. The third heating element 10433 is connected to the positive terminal 1037 through a third positive terminal 10491.

The negative terminals of the heating elements 1043 are connected to the body of the electronic cigarette 10, which connects to the negative terminal 1035 of the electrical power supply. A first positive terminal isolation ring 10472 is used to isolate the first positive terminal 10471 and the heating element base 1045. A second positive terminal isolation ring 10482 is used to isolate the first positive terminal 10471 and the second positive terminal 10481. A third positive terminal isolation ring 10492 is used to isolate the third positive terminal 10491 and the second positive terminal 10481. A heating element sealing ring 1046 seals the vaporizer assembly 102 and the electronic cigarette base assembly 103 to prevent the E-liquid in the vaporizer assembly 102 from leaking into the electronic cigarette base assembly 103.

In certain embodiments, each display circuit is used for each of the heating elements 1043 to indicate whether the corresponding heating element is powered up and in use. Each of the display circuits has a resistor and a light emitting diode (LED). The resister and the LED are connected in serial. A first terminal of the resistor forms a first terminal of the corresponding display circuit. A second terminal of the resistor is connected to the anode of the LED. The cathode of the LED forms a second terminal of the corresponding display circuit. The first terminal of the corresponding display circuit is electrically coupled to the corresponding output terminal of the printed circuit board 1031, and the second terminal of the corresponding display circuit is electrically coupled to the negative terminal of the printed circuit board 1031 and the negative terminal 1035 of the electronic cigarette 10. For example, a first display circuit includes a resistor R1 and a light emit diode (LED) D1 connected in serial, and the first display circuit is parallelly connected to the first heating element 10431. Other display circuits are connected to their corresponding heating elements in similar manner. Each of the LEDs may be incorporated into its corresponding push button switch. In one embodiment, each of the push button switches may include a hole to install an LED. In another embodiment, perimeter of the push button switch may be surrounded with transparent materials to show light of the LEDs.

In certain embodiments, each push button switch has a first terminal electrically coupled to a corresponding switching terminal, and a second terminal electrically coupled to a corresponding output terminal and the positive terminal of a corresponding heating element, and the negative terminal of the corresponding heating element is electrically coupled to the negative terminal of the printed circuit board 1031 and the negative terminal 1035 of the electrical power supply.

In certain embodiments, the electronic cigarette base assembly 103 includes: a switch mounting ring 1033, an air chamber body 1026, and an air intake adjustment ring 1025. The switch mounting ring 1033 is mounted at a bottom end of the vaporizer assembly mounting base 1024. The multiple push button switches are installed on the switch mounting ring 1033. The air chamber body 1026 defines a first air chamber opening 10261 and a second air chamber opening 10262. The air chamber body 1026 is positioned between the vaporizer assembly mounting base 1024 and the switch mounting ring 1033 to form an air chamber. The air intake adjustment ring 1025 is rotatably installed outside of the air chamber body 1026. The air intake adjustment ring 1025 defines a first air intake opening 10251 and a second air intake opening 10252. The user may rotate the air intake adjustment ring 1025 to adjust air intake to coincide the first air chamber opening 10261 and the second air chamber opening 10262, respectively. Each of the switch mounting ring 1033, the vaporizer assembly mounting base 1024, the air chamber body 1026, and the air intake adjustment ring 1025 is in a ring shape to form the air chamber in the center of the air chamber body 1026.

Figure 9:
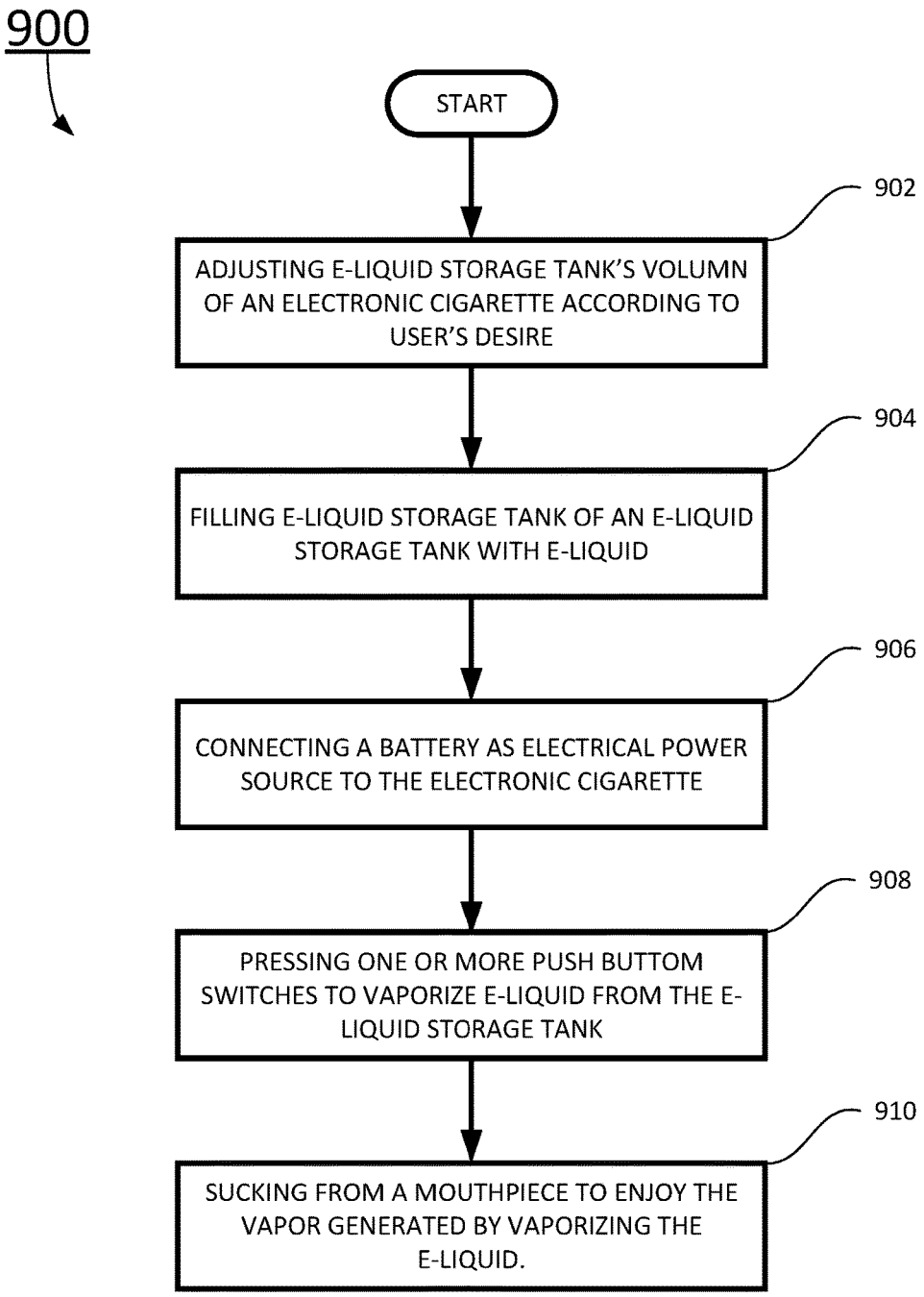

In yet another aspect, the present disclosure relates to a method 900 of using an electronic cigarette 10 having adjustable E-liquid storage tank according to certain embodiments of the present disclosure, as shown in FIG. 9.

At block 902, a user of the electronic cigarette 10 may adjust E-liquid Storage Tank's volume of the electronic cigarette 10 according to user's desire. In one embodiment, the user may insert a large size (tall and/or thick) volume adjustment ring 1044 to take more space of the E-liquid Storage Tank so that the E-liquid to be filled in the E-liquid Storage Tank will be less in volume. In another embodiment, the user may install a smaller size (short and/or thin) volume adjustment ring 1044 to take less space of the E-liquid Storage Tank so that the E-liquid to be filled in the E-liquid Storage Tank will be more in volume. In yet another embodiment, the user may decide to remove the volume adjustment ring 1044 so that the E-liquid to be filled in the E-liquid Storage Tank will achieve maximum capacity of the E-liquid Storage Tank.

At block 904, the user of the electronic cigarette 10 may fill the E-liquid storage tank 111 of a vaporizer assembly 102 of the electronic cigarette 10 with E-liquid. In one embodiment, the E-liquid storage tank 111 is a refillable E-liquid storage tank. As shown in FIG. 6, a mouthpiece 1011 and a first refill sealing ring 1014 may be removed, and the user may refill E-liquid through a first refilling opening 10131 and a second refilling opening 10132 of an E-liquid refill base 1013 of a mouthpiece assembly 101 into the E-liquid storage tank 111 between the E-liquid storage tank external wall 1022 and the E-liquid storage tank internal wall 1041. In certain embodiments, the E-liquid storage tank 111 is not refillable, and the E-liquid storage tank 111 has already been filled with adequate E-liquid.

Figure 2:
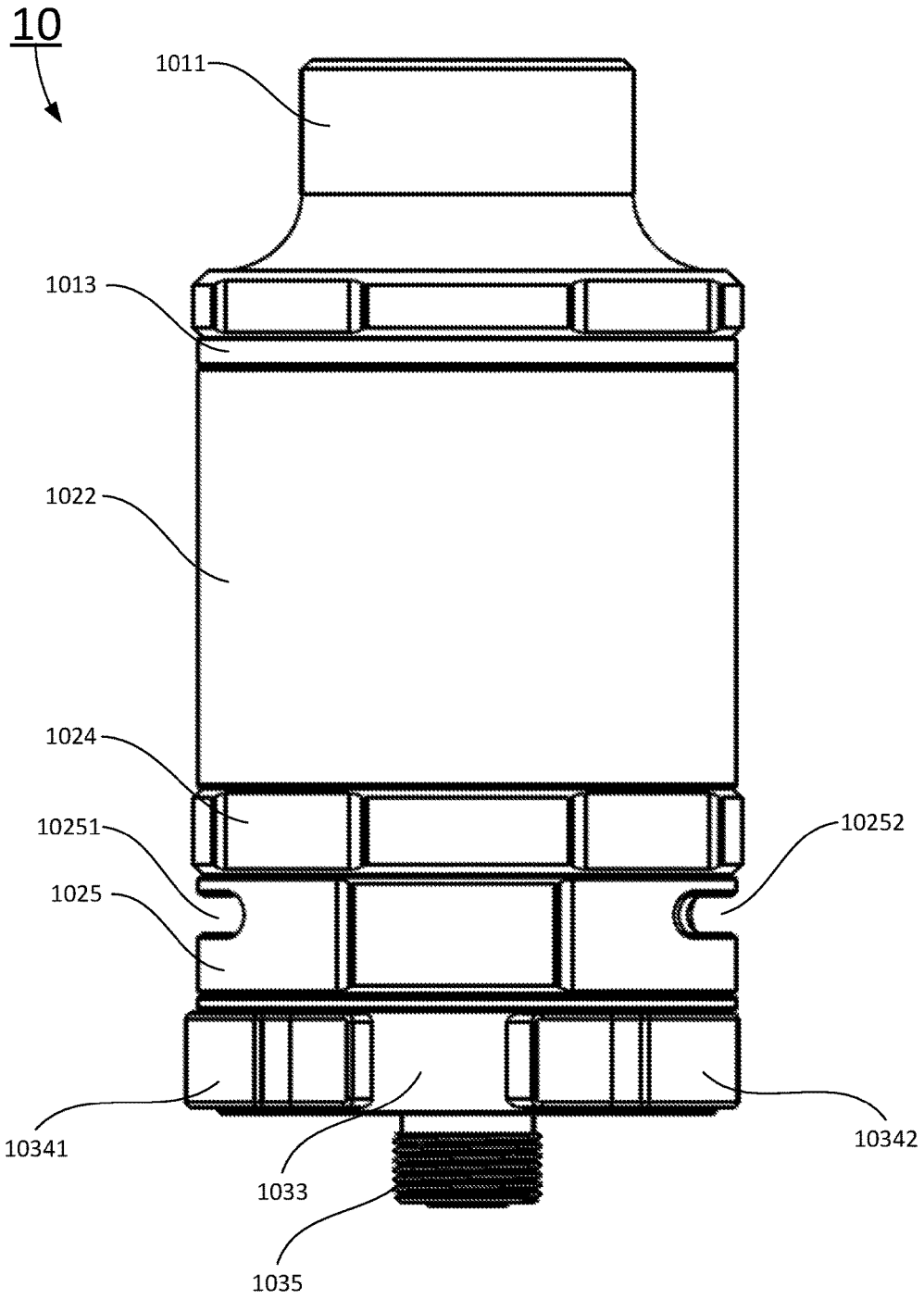
FIG. 2 is a side view of the exemplary electronic cigarette having adjustable E-liquid storage tank according to certain embodiments of the present disclosure.
Figure 3:
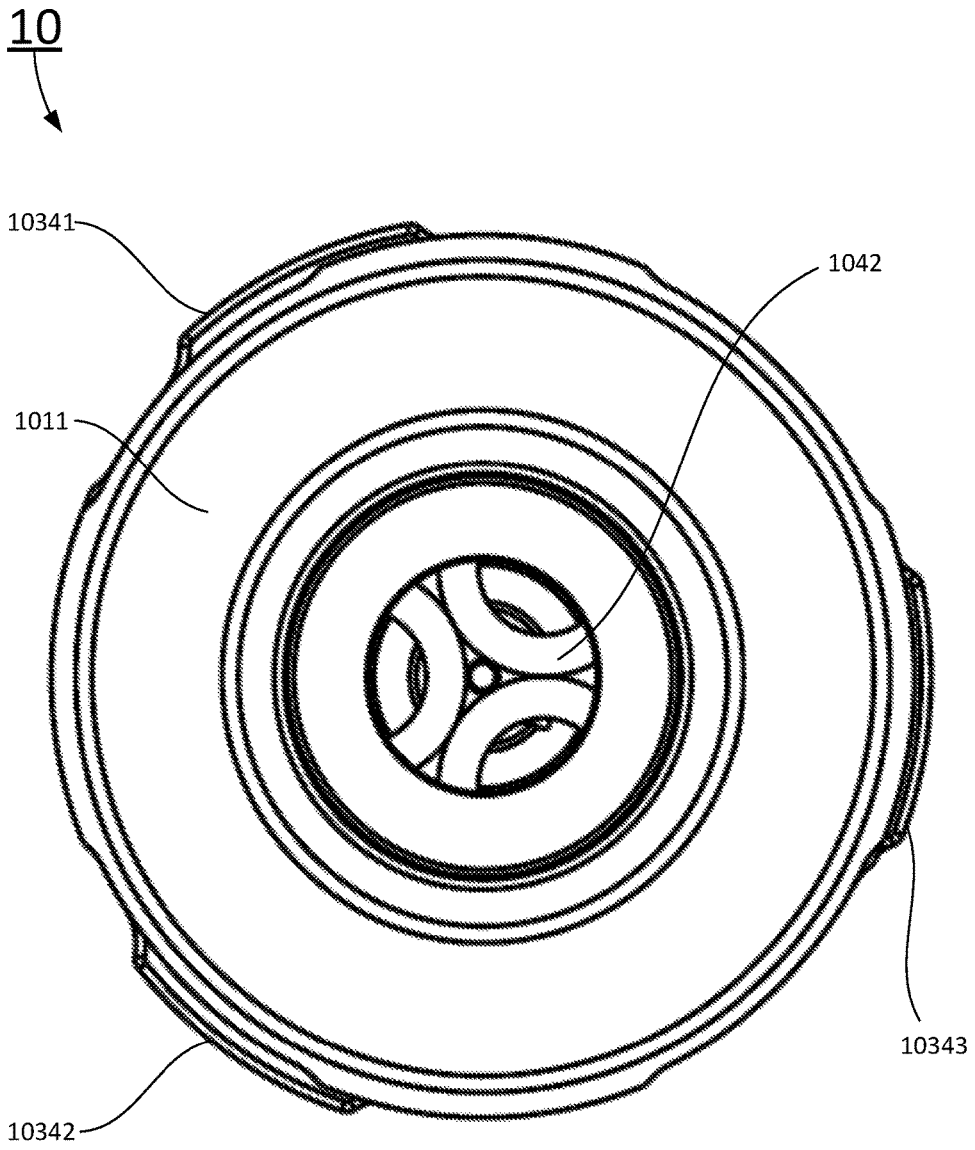
FIG. 3 is a top view of the exemplary electronic cigarette having adjustable E-liquid storage tank showing a vaporizer with multiple heating elements according to certain embodiments of the present disclosure.

At block 906, the user may connect an electrical power supply to the electronic cigarette 10. The electronic cigarette 10 has a positive terminal 1037 and a negative terminal 1035. The electrical power supply may include a battery or a rechargeable battery. The electrical power supply is connected to the positive terminal 1037 and the negative terminal 1035 of the electronic cigarette 10 through one of: a T-shaped groove connector, a dovetail shaped slot connector, a magnetic attachment connector, a threaded connector, and a multi-threaded connector. In certain embodiments, as shown in FIGS. 1, 2 and 5, the electrical power supply is connected to the electronic cigarette 10 through a threaded connector, or a multi-threaded connector.

At block 908, the user presses one or more push button switches to turn on the electrical power supply connected to one or more heating elements 1043 according to the desired amount vapor the user wishes to have, one push button switch corresponds to one heating element.

At block 910, the user sucks E-liquid vapor from the vaporizer assembly 102 through a mouthpiece 1011. Air outside of the electronic cigarette 10 enters the vaporizer assembly 102 through an air intake adjustment ring 1025. The air intake adjustment ring 1025 defines a first air intake opening 10251 and a second air intake opening 10252. The air intake adjustment ring 1025 is rotatably positioned outside of an air chamber body 1026. The air chamber body 1026 defines a first air chamber opening 10261 and a second air chamber opening 10262. The user may rotate the air intake adjustment ring 1025 to adjust the air intake to the air chamber body 1026. In one embodiment, the air intake adjustment ring 1025 is adjusted to a maximum position so that the first air intake opening 10251 and the second air intake opening 10252 coincide the first air chamber opening 10261 and the second air chamber opening 10262 of the air chamber body 1026, respectively to allow maximum air flow into the air chamber body 1026. In another embodiment, the air intake adjustment ring 1025 is adjusted to a minimum position so that the first air intake opening 10251 and the second air intake opening 10252 overlaps the first air chamber opening 10261 and the second air chamber opening 10262 of the air chamber body 1026 partially to reduce the air intake to the air chamber body 1026 to its minimum. The air in the air chamber body 1026 is vaporized by the vaporizer assembly 102, and vapor formed by the vaporizer assembly 102 exits through the mouthpiece 1011.

In certain embodiments, the method also includes: removing, by the user, the volume adjustment ring from the E-liquid storage tank to obtain maximum E-liquid capacity of the E-liquid storage tank.

In certain embodiments, the method may further include: removing, by the user, the electrical power supply from the electronic cigarette for replacement or recharging.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to activate others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims, the foregoing description and the exemplary embodiments described therein, and accompanying drawings.

What is claimed is:

1. An E-liquid storage tank for an electronic cigarette, comprising:

an E-liquid refill base;

an E-liquid storage tank internal wall;

an E-liquid storage tank external wall;

a vaporizer assembly mounting base, and a volume adjustment ring, wherein the volume adjustment ring is removeably installed inside the E-liquid storage tank between the E-liquid storage tank internal wall and the E-liquid storage tank external wall to reduce the amount of E-liquid filled in the E-liquid storage tank, wherein the E-liquid storage tank is sealed by a first mouthpiece sealing ring on the top, and a vaporizer sealing ring at the bottom.

2. The E-liquid storage tank of claim 1, wherein the E-liquid storage tank external wall comprises transparent materials such that remaining E-liquid level is shown to a user, wherein the transparent materials comprise: plastics, acrylics, and glass.

3. The E-liquid storage tank of claim 1, wherein the volume adjustment ring comprises one or more thicknesses to adjust the E-liquid storage tank volume.

4. The E-liquid storage tank of claim 1, wherein the volume adjustment ring comprises one or more heights to adjust the E-liquid storage tank volume.

5. The E-liquid storage tank of claim 1, wherein the volume adjustment ring is removeable, wherein when the volume adjustment ring is removed, the E-liquid storage tank achieves maximum E-liquid storage tank volume.

6. The E-liquid storage tank of claim 1, wherein the volume adjustment ring comprises silicone gel, plastics, acrylic, glass, and metals.

7. An electronic cigarette, comprising:

an E-liquid storage tank, wherein the volume of the E-liquid storage tank is adjustable using a volume adjustment ring; and a vaporizer assembly having a heating element assembly, wherein the heating element assembly comprises:

an E-liquid storage tank internal wall defining a plurality of E-liquid openings to allow an external E-liquid storage medium, and an internal E-liquid storage medium to receive E-liquid from the E-liquid storage tank;

a plurality of heating elements in direct contact with surface of the internal E-liquid storage medium to heat the E-liquid received from the E-liquid storage tank, wherein a user switches on one or more of the plurality of the heating elements to adjust the vaporization of the E-liquid.

8. The electronic cigarette of claim 7, wherein the E-liquid storage tank comprises:

an E-liquid refill base;

the E-liquid storage tank internal wall;

an E-liquid storage tank external wall;

a vaporizer assembly mounting base, and the volume adjustment ring, wherein the volume adjustment ring is installed inside the E-liquid storage tank between the E-liquid storage tank internal wall and the E-liquid storage tank external wall to reduce the amount of E-liquid filled in the E-liquid storage tank, wherein the E-liquid storage tank is sealed by a first mouthpiece sealing ring on the top, and a vaporizer sealing ring at the bottom.

9. The electronic cigarette of claim 7, wherein the E-liquid storage tank external wall comprises transparent materials such that remaining E-liquid level is shown to the user, wherein the transparent materials comprise: plastics, acrylics, and glass.

10. The electronic cigarette of claim 7, wherein the volume adjustment ring comprises: one or more thicknesses to adjust the E-liquid storage tank volume.

11. The electronic cigarette of claim 7, wherein the volume adjustment ring comprises: one or more heights to adjust the E-liquid storage tank volume.

12. The electronic cigarette of claim 7, wherein the volume adjustment ring is removeable, wherein when the volume adjustment ring is removed, the E-liquid storage tank achieves maximum E-liquid storage tank volume.

13. The electronic cigarette of claim 7, wherein the volume adjustment ring comprises silicone gel, plastics, acrylic, glass, and metals.

14. The electronic cigarette of claim 7, further comprising a mouthpiece assembly having:

a mouthpiece for user to enjoy vaporized E-liquid;

a mouthpiece fastener positioned coaxially inside the mouthpiece to form an internal vapor pathway;

a threaded mouthpiece mounting ring having external threads to mount the mouthpiece assembly on the vaporizer assembly through an internal mouthpiece mounting threads of the vaporizer assembly;

a first mouthpiece sealing ring to seal the top end of the E-liquid storage tank; and a second mouthpiece sealing ring to block vapor passage between the mouthpiece and the threaded mouthpiece mounting ring.

15. The electronic cigarette of claim 7, wherein each of the plurality of heating elements is parallelly coupled to a display circuit having a resistor and a light emitting diode connected in serial to indicate whether the heating element is powered up and in use.

16. The electronic cigarette of claim 7, wherein each of the plurality of heating elements comprises a positive terminal and a negative terminal, wherein the positive terminal of the heating element is electrically coupled to a positive terminal of an electrical power supply through a push button switch in serial, and the negative terminal of the heating element is electrically coupled to a negative terminal of the electrical power supply.

17. The electronic cigarette of claim 16, further comprising a printed circuit board having:

a positive terminal electrically coupled to the positive terminal of the electrical power supply;

a negative terminal electrically coupled to the negative terminal of the electrical power supply;

a plurality of switching terminals, one for each of the plurality of heating elements; and a plurality of output terminals, one for each of the plurality of heating elements, wherein each push button switch has a first terminal electrically coupled to a corresponding switching terminal, and a second terminal electrically coupled to a corresponding output terminal and the positive terminal of a corresponding heating element, and the negative terminal of the corresponding heating element is electrically coupled to the negative terminal of the printed circuit board and the negative terminal of the electrical power supply.

18. The electronic cigarette of claim 16, further comprising an electronic cigarette base assembly having:

a switch mounting ring mounted at a bottom end of the vaporizer assembly mounting base, wherein a plurality of push button switches is installed on the switch mounting ring;

an air chamber body defining a first air chamber opening, and a second air chamber opening, wherein the air chamber body is positioned between the vaporizer assembly mounting base and the switch mounting ring to form an air chamber;

an air intake adjustment ring defining a first air intake opening and a second air intake opening to adjust air intake by rotating the air intake adjustment ring to coincide the first air chamber opening and the second air chamber opening, respectively, wherein each of the switch mounting ring, the vaporizer assembly mounting base, the air chamber body, and the air intake adjustment ring is in a ring shape to form the air chamber inside the air chamber body.

19. A method of using an electronic cigarette having an adjustable volume E-liquid storage tank, comprising:

adjusting, by a user, the volume of the E-liquid storage tank by installing a volume adjustment ring into an E-liquid storage tank;

filling, by the user, E-liquid into the E-liquid storage tank;

pressing, by the user, one or more push button switches to turn on an electrical power supply to one or more heating elements according to the desired amount vapor the user wishes to have, wherein one push button switch corresponds to one of the plurality of heating elements; and sucking, by the user, E-liquid vapor from a vaporizer assembly through a mouthpiece, wherein air outside of the electronic cigarette enters the vaporizer assembly through a first air intake opening and a second air intake opening defined on an air intake adjustment ring that coincide a first air chamber opening and a second air chamber opening defined on an air chamber body, respectively, and the E-liquid vapor formed by the vaporizer assembly exits through the mouthpiece.

20. The method of claim 19, further comprising one or more of:

connecting, by the user, the electrical power supply to a positive terminal and a negative terminal of the electronic cigarette, wherein the electrical power supply comprises a battery, or a rechargeable battery, and the electrical power supply is connected to the positive terminal and the negative terminal of the electronic cigarette through one of:

a T-shaped groove connector;

a dovetail shaped slot connector;

a magnetic attachment connector;

a threaded connector; and a multi-threaded connector;

removing, by the user, the volume adjustment ring from the E-liquid storage tank to obtain maximum E-liquid capacity of the E-liquid storage tank; and removing, by the user, the electrical power supply from the electronic cigarette for replacement or recharging.

* * * * *